US009307614B2

(12) United States Patent
Chen et al.

(10) Patent No.: US 9,307,614 B2
(45) Date of Patent: Apr. 5, 2016

(54) COLOR TEMPERATURE AND ILLUMINATION ADJUSTING SYSTEM, AND METHOD THEREOF

(71) Applicant: LEXTAR ELECTRONICS CORPORATION, Hsinchu (TW)

(72) Inventors: Chun-Kuang Chen, Hsinchu (TW); Feng-Ling Lin, Hsinchu (TW); Hui-Ying Chen, Hsinchu (TW); Po-Shen Chen, Hsinchu (TW); Yuan-Ching Chen, Hsinchu (TW)

(73) Assignee: Lextar Electronics Corporation, Hsinchu (TW)

( * ) Notice: Subject to any disclaimer, the term of this patent is extended or adjusted under 35 U.S.C. 154(b) by 290 days.

(21) Appl. No.: 13/862,334

(22) Filed: Apr. 12, 2013

(65) Prior Publication Data

US 2013/0271031 A1 Oct. 17, 2013

(30) Foreign Application Priority Data

Apr. 13, 2012 (TW) ..... 101113131 A

(51) Int. Cl.

| | |
|---|---|
| ***G05F 1/00*** | (2006.01) |
| ***H05B 37/02*** | (2006.01) |
| ***H05B 33/08*** | (2006.01) |

(52) U.S. Cl.
CPC ..... *H05B 37/02* (2013.01); *H05B 33/086* (2013.01)

(58) Field of Classification Search
CPC ..... H05B 33/0857; H05B 33/0863; H05B 37/029; H05B 37/02
USPC ..... 315/291, 297, 307
See application file for complete search history.

(56) References Cited

U.S. PATENT DOCUMENTS 8,040,075 B2 * 10/2011 Horino ..... 315/291

* cited by examiner

*Primary Examiner* — Diana J Cheng

(57) ABSTRACT

A temperature and illumination adjusting system, including: a temperature and illumination adjusting device, including a CPU, receiving a temperature value and an illumination value, and generating a first PWM value and a second PWM value according to a first formula and a second formula; and a communication unit, outputting the first PWM value and the second PWM value; and a lamp device, including a lamp communication unit, receiving the first PWM value and the second PWM value; a first light module; a second light module; a first PWM driving unit, driving the first light module with the first PWM value; a second PWM driving unit, driving the second light module with the second PWM value, wherein the outputs of the first light module and the second light module have different color temperature.

8 Claims, 5 Drawing Sheets

| Illumination (lm) | 600 | | 550 | | 400 | | 350 | | 250 | |
|---|---|---|---|---|---|---|---|---|---|---|
| Pulse Width Modulation Value (%) | PWM1 | PWM2 | PWM1 | PWM2 | PWM1 | PWM2 | PWM1 | PWM2 | PWM1 | PWM2 |
| | 80 | 11 | 70 | 11 | 6 | 80 | 6 | 60 | 6 | 40 |
| | 70 | 23 | 60 | 25 | 15 | 70 | 13 | 50 | 13 | 30 |
| | 60 | 37 | 50 | 39 | 21 | 60 | 21 | 40 | 19 | 20 |
| | 50 | 50 | 40 | 53 | 29 | 50 | 28 | 30 | 26 | 10 |
| | 40 | 65 | 30 | 68 | 36 | 40 | 35 | 20 | | |
| | 30 | 80 | 20 | 84 | 42 | 30 | 41 | 10 | | |
| | | | | | 50 | 20 | | | | |
| | | | | | 57 | 10 | | | | |

FIG. 2A

COLOR TEMPERATURE AND ILLUMINATION ADJUSTING SYSTEM, AND METHOD THEREOF

CROSS REFERENCE TO RELATED APPLICATIONS

This Application claims priority of Taiwan Patent Application No. 101113131, filed on Apr. 13, 2012, the entirety of which is incorporated by reference herein.

TECHNICAL FIELD

The invention relates to color temperature and illumination adjusting systems, and more particularly to color temperature and illumination adjusting systems controlling the pulse width modulation.

BACKGROUND

The conventional adjustment of the illumination and the color temperature of light-emitting diode (LED) lights is generally performed based on a simple linear correlation between a duty cycle of Pulse Width Modulation (PWM) and the illumination. However, due to LEDs having different characteristics at different temperatures or using different circuit arrangements, the correlation between the LED's illumination/color temperature and the duty cycle may not be a simple linear correlation, so that using the conventional manner of adjustment makes it difficult to accurately output light source corresponding to illumination. Furthermore, the light source apparatus uses an internal micro-controller to operate the calculation of the pulse modulation, but it is limited by the performance of the internal micro-controller, so that it is difficult to generate an accurate calculation result. If the conventional light source apparatus must perform a more complicated calculation, the reaction of the light source apparatus may decrease.

SUMMARY

An embodiment of a temperature and illumination adjusting system comprises a temperature and illumination adjusting device and a lamp device. The temperature and illumination adjusting device comprises a central processing unit, a memory unit, and a communication unit. The central processing unit receives an illumination value and a color-temperature value, and generates a first PWM value and a second PWM value according to a first formula and a second formula. The memory unit stores the first formula and the second formula, wherein the first formula indicates the correlation between the first PWM value, the second PWM value and the illumination value, and wherein the second formula indicates the correlation between the first PWM value, the second PWM value and the color-temperature value. The communication unit outputs the first PWM value and the second PWM value. The lamp device comprises a lamp communication unit, a first PWM driving unit, a second PWM driving unit, a first light module, and a second light module. The lamp communication unit receives the first PWM value and the second PWM value. The first PWM driving unit drives the first light module by the first PWM value, and the second PWM driving unit drives the second light module by the second PWM value. The outputs of the first light module and the second light module have different color temperatures.

An embodiment of a temperature and illumination adjusting method comprises: obtaining an illumination value and a color-temperature value; generating a first PWM value and a second PWM value according to a first formula and a second formula, wherein the first formula indicates the correlation between the first PWM value, the second PWM value and the illumination value, and wherein the second formula indicates the correlation between the first PWM value, the second PWM value and the color-temperature value; transmitting the first PWM value and the second PWM value to an external lamp device; driving the first light module of the external lamp device by the first PWM value; and driving the second light module of the external lamp device by the second PWM value, wherein the outputs of the first light module and the second light module have different color temperatures.

BRIEF DESCRIPTION OF DRAWINGS

The invention will become more fully understood by referring to the following detailed description with reference to the accompanying drawings, wherein:

FIG. 2A is an experiment data table showing an embodiment of the PWM values PWM1 and the PWM values PWM2 at different illumination values L;

DESCRIPTION OF EMBODIMENTS

The manufacture and use of the embodiments of the present disclosure are discussed in detail below. It should be appreciated, however, that the embodiments provide many applicable inventive concepts that can be embodied in a wide variety of specific contexts. The specific embodiments discussed are merely illustrative of specific ways to make and use the disclosure, and do not limit the scope of the disclosure.

Figure 1:
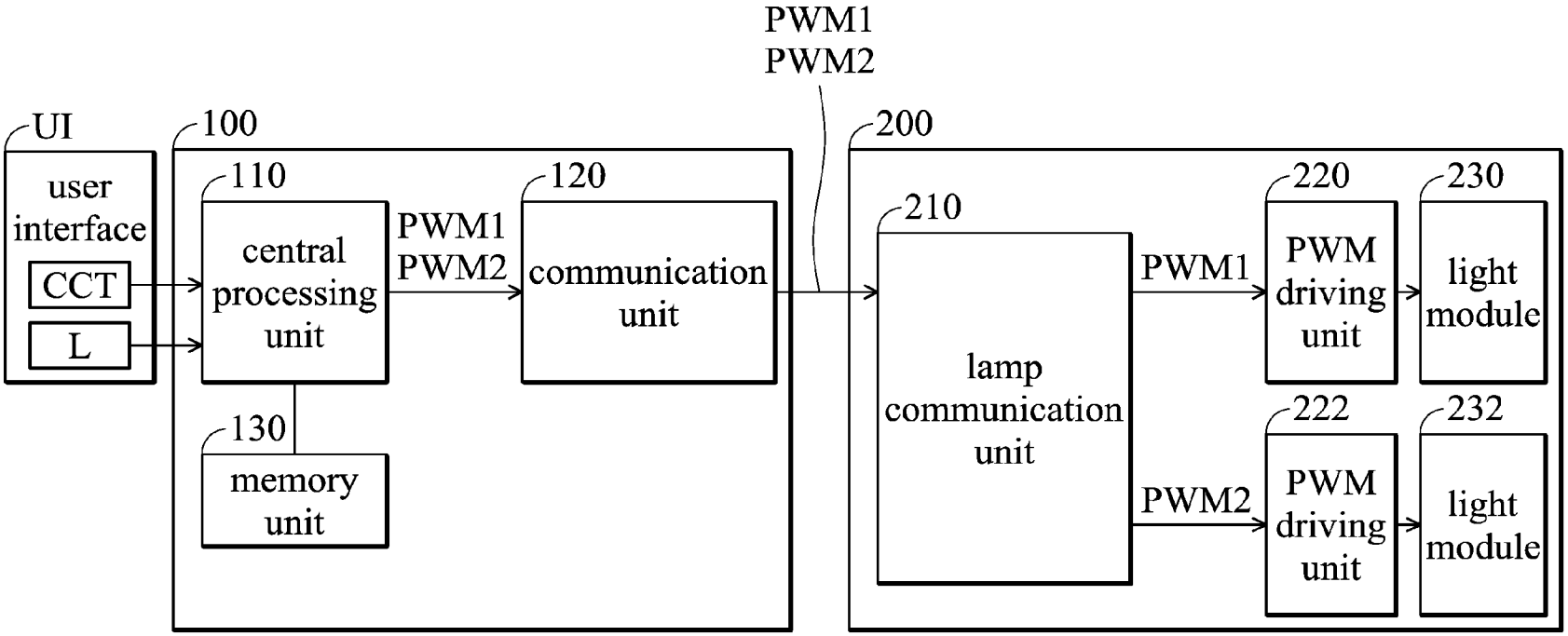
FIG. 1 is a block diagram illustrating an embodiment of a temperature and illumination adjusting system.

FIG. 1 is a schematic diagram illustrating an embodiment of a temperature and illumination adjusting device 100. The temperature and illumination adjusting device 100 comprises a central processing unit 110, a communication unit 120, and a memory unit 130. A lamp device 200 comprises a lamp communication unit 210, PWM driving units 220 and 222, and light modules 230 and 232, wherein the light module 230 and the light module 232 have different color temperatures. In some embodiments, light modules are light-emitting diodes.

Because the light module 230 and the light module 232 of the lamp device 200 have different color temperatures, the combination of the light module 230 and the light module 232 with different illuminations can generate mixing lights of different color temperatures and illuminations. Also, the light module 230 and the light module 232 can be driven by different duty cycles of Pulse-Width Modulation to output different illuminations. Therefore, the duty cycles of Pulse-Width Modulation (referred to as PWM value hereafter) PWM1 and PWM2 of the light module 230 and the light module 232 can be set in order to adjust the color temperatures and illuminations of mixing lights.

Figure 2B:
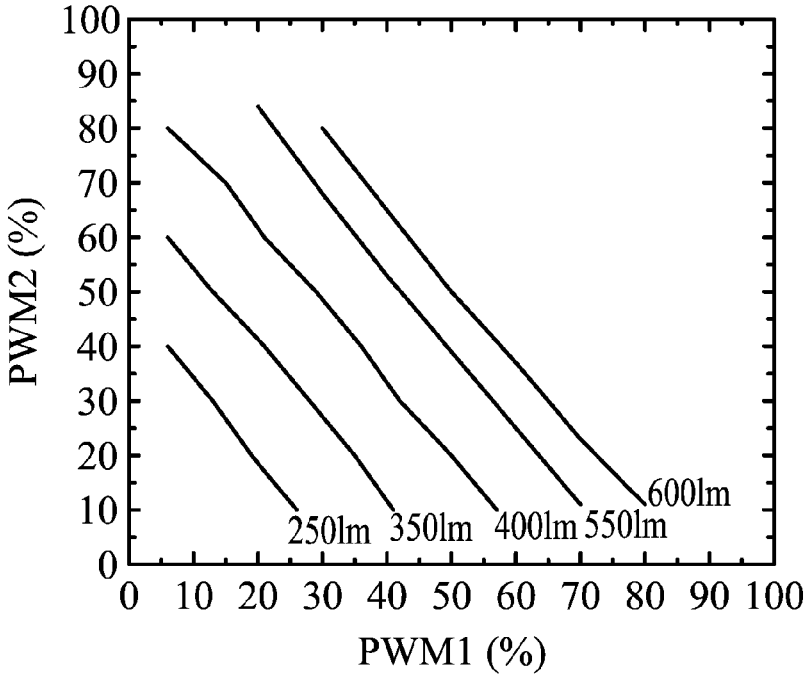
FIG. 2B is schematic diagram illustrating the correlation between the PWM values PWM1 and the PWM values PWM2 at different illumination values L.

In some embodiments, when a user or an application program adjusts the color temperatures CCT and the illuminations L of the lamp device 200, the user can input the color temperatures CCT and the illuminations L to the central processing unit 110 via a user interface UI. When the central processing unit 110 receives the color temperatures CCT and the illuminations L, the central processing unit 110 calculates according to the color temperatures CCT, the illuminations L, and a first formula and a second formula stored in memory unit 130. The first formula indicates the correlation between the first PWM value PWM1, the second PWM value PWM2 and the illumination value L, as follows: $PWM2=A(L)+B(L)*PWM1$, wherein $A(L)=a_1+a_2L$, $B(L)=b_1+b_2L$, and $a_1$, $a_2$, $b_1$, $b_2$ are constants. Note that different specifications of light modules or different combinations of light modules may have different constants $a_1$, $a_2$, $b_1$, and $b_2$, wherein the constants $a_1$, $a_2$, $b_1$, and $b_2$ may be obtained by experimentation or nonlinear regression analysis. For example, the experiment data in FIG. 2A can be obtained by experimentation. Next, after data for the combinations of the Pulse-Width Modulation values PWM1 and PWM2 at different illuminations is obtained, an approximation formula of the relationship between the Pulse-Width Modulation values PWM1 and PWM2 under a fixed illumination can be calculated according to the data in FIG. 2A. For example, the data in FIG. 2A may derives five formulas indicating the correlation between the Pulse-Width Modulation values PWM1 and PWM2, and the formulas corresponding to illuminations 250 lm, 350 lm, 400 lm, 550 lm, and 600 lm, respectively, as follows: $PWM2=-1.3829*PWM1+120.39$ (600 lm); $PWM2=-1.4514*PWM1+111.98$ (550 lm); $PWM2=-1.3935*PWM1+89.593$ (400 lm); $PWM2=-1.4091*PWM1+68.818$ (350 lm); $PWM2=-1.5138*PWM1+49.22$ (250 lm). Also, FIG. 2B shows these formulas illustrated as curves on a coordinate axis. Next, these formulas are substituted into the first formula $PWM2=A(L)+B(L)*PWM1$, as A(600 lm)=−1.3829, B(600 lm)=120.39; A(550 lm)=−1.4514, B(550 lm)=111.98; A(400 lm)=−1.3935, B(400 lm)=89.593; A(350 lm)=−1.4091 B(350 lm)=68.818; and A(250 lm)=−1.5138, B(250 lm)=49.22. Therefore, based on the above data, the approximate formulas $A(L)=0.0003L-1.5537$ and $B(L)=0.2039L-0.5584$ can be obtained. Finally, by comparing the formulas $A(L)=0.0003L-1.5537$ and $B(L)=0.2039L-0.5584$ with $A(L)=a_1+a_2L$ and $B(L)=b_1+b_2L$, we can determine that the constants $a_1$, $a_2$, $b_1$, $b_2$ are 0.0003, −1.5537, 0.2039, and −0.5584, respectively. It should be noted that the data recited above is merely for example, and the invention is not limited thereto.

Figure 2C:
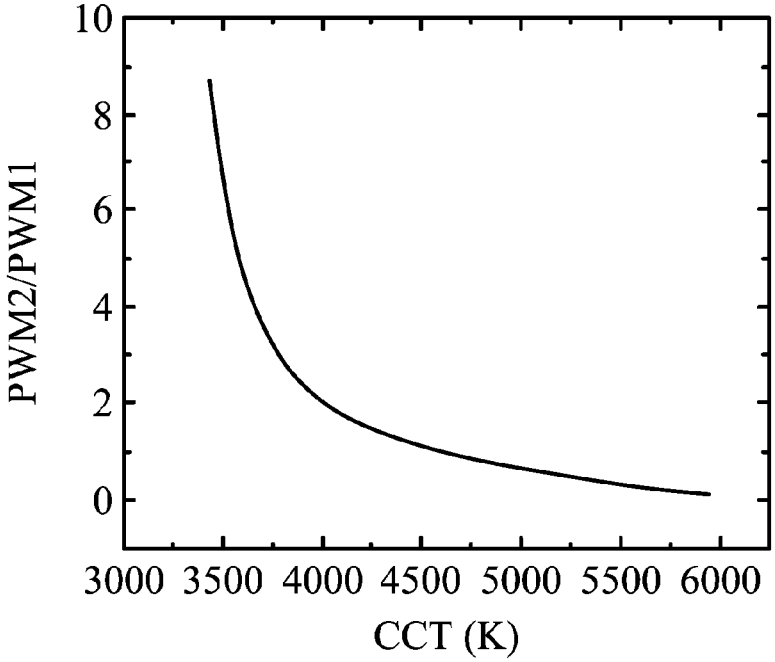
FIG. 2C is schematic diagram illustrating the correlation between the ratios of the PWM value PWM1 to the PWM value PWM2 and different color temperatures CCT.

The second formula indicates the correlation between the PWM value PWM1, the PWM value PWM2 and the color temperatures CCT, as follows: $PWM2/PWM1=c1*e^{-CCT/c2}+c3$, wherein $c_1$, $c_2$, $c_3$ are constants, and e is a mathematical constant. Note that different specifications of light modules or different combinations of light modules may have different constants $c_1$, $c_2$, $c_3$, wherein the constants $c_1$, $c_2$, $c_3$ may be obtained by experimentation or nonlinear regression analysis. For example, data sets for the ratios of the PWM value PWM1 to the PWM value PWM2 and the corresponding color temperatures CCT can be obtained by conducting experiments, and the formula for the ratios PWM2/PWM1 and the color temperatures CCT may be obtained by nonlinear regression analysis according to the data sets. Next, the constants $c_1$, $c_2$, $c_3$ may be obtained by coefficient comparison between the experiment formula and the second formula, and illustrated as curves on a coordinate axis as shown in FIG. 2C.

Figure 2D:
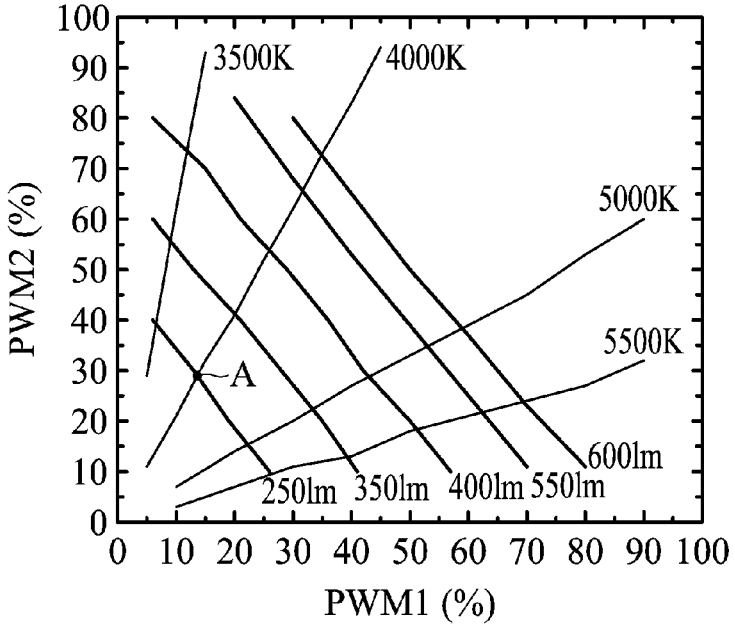
FIG. 2D is schematic diagram illustrating the correlation between the PWM values PWM1 and the PWM values PWM2 at different illumination values L and different color temperatures CCT.

It should be noted that the central processor 110 may substitute the illumination value L and the color temperature CCT into the first formula and the second formula, respectively. Therefore, the two formulas of the PWM value PWM1 and the PWM value PWM2 are obtained, such that the PWM value PWM1 and the PWM value PWM2 can be derived from the formulas. For example, as shown in FIG. 2D, if the illumination value L is 250 lm and the color temperature CCT is 4000K, 250 lm and 4000K are substituted into the first formula and the second formula, respectively. Therefore, the formulas can indicate the correlation between the PWM value PWM1 and the PWM value PWM2 on isoluminance curve 250 lm and the correlation between the PWM value PWM1 and the PWM value PWM2 on isotemperature curve 4000K. Finally, the central processing unit 110 obtains the solution of the two formulas as the PWM value PWM1 and the PWM value PWM2 on intersection point A.

In order to determine a more accurate correlation between the PWM value PWM1, the PWM value PWM2 and the color temperatures CCT, the second formula can be $PWM2/PWM1=c1*e^{-CCT/c2}+c3*e^{-CCT/c4}+c5$ in some embodiments, wherein $c_1$, $c_2$, $c_3$, $c_4$, $c_5$ are constants, and e is a mathematical constant. Similarly, different specifications of light modules or different combinations of light modules may have different constants $c_1$, $c_2$, $c_3$, $c_4$, $c_5$, and the constants $c_1$, $c_2$, $c_3$, $c_4$, $c_5$ may be obtained by experimentation or nonlinear regression analysis. Also, a plurality of data sets can be obtained by experimentation, and the approximate formula of the ratios PWM2/PWM1 and the color temperatures CCT may be obtained by nonlinear regression analysis according to the data sets. Next, the constants $c_1$, $c_2$, $c_3$, $c_4$, $c_5$ may be obtained by coefficient comparison between the experiment formula and the second formula.

In some embodiments, when the central processing unit 110 has obtained the PWM value PWM1 and the PWM value PWM2, the communication unit 120 transmits the PWM value PWM1 and the PWM value PWM2 to the lamp communication unit 210. Next, the lamp communication unit 210 transmits the PWM value PWM1 and the PWM value PWM2 to the PWM driving unit 220 and the PWM driving unit 222 respectively, and the PWM driving unit 220 and the PWM driving unit 222 drive the light modules 230 and 232 according to the PWM value PWM1 and the PWM value PWM2. Therefore, the mixing light generated by the light modules 230 and 232 matches the color temperature CCT and the illumination value L of the user's request. Furthermore, an adjustment of the color temperature of mixing light under a fixed illumination value, or an adjustment of the illumination value of mixing light under a fixed color temperature can be performed according to the present invention.

It should be noted that the first formula and the second formula are too complex for the controller of a conventional lamp device to calculate, and the micro-controller of a conventional lamp device is incapable of processing a floating-point calculation, so the result of such a calculation may be inaccurate. Therefore, an embodiment of the invention uses the central processing unit 110 to operate the calculation, and then the central processing unit 110 transmits the PWM value PWM1 and the PWM value PWM2 to the lamp device 200. Next, the lamp device 200 drives the light modules 230 and 232 according to the calculated PWM value PWM1 and the PWM value PWM2 without any further calculations. Accordingly, the reaction speed of the lamp device 200 increases, and the accuracy of controlling the color temperature CCT and the illumination value L is improved.

Furthermore, in some embodiment of the invention, the central processing unit 110 further adjusts the PWM value PWM1 and the PWM value PWM2 according to the sensed illumination of the human eye, so that the color temperature CCT and the illumination value L sensed by the user may be more correct. In order to output light with accurate color temperature and illumination values, the central processing unit 110 can also adjust the PWM value PWM1 and the PWM value PWM2 according to the temperature of the lamp device 200.

Figure 3:
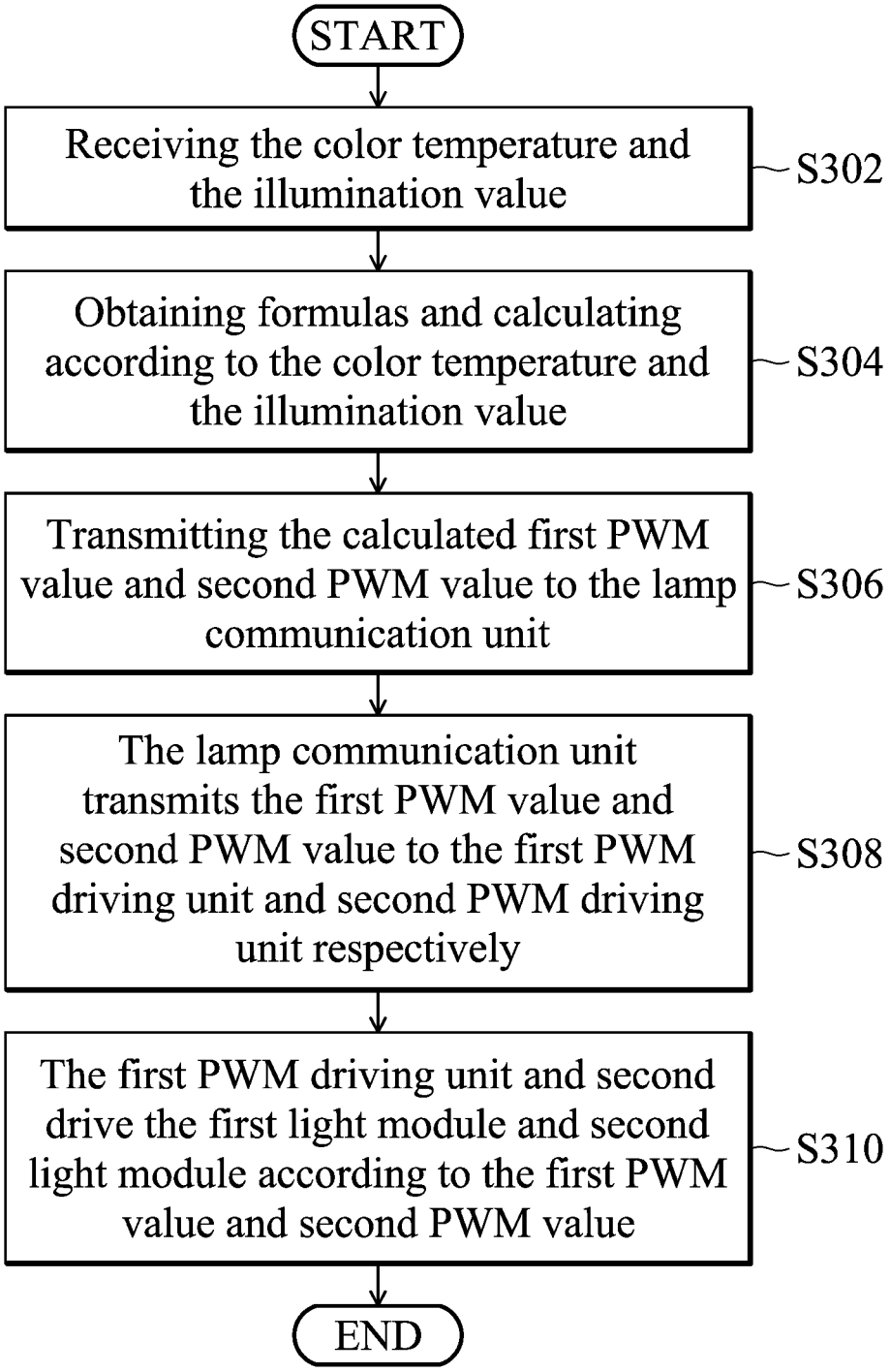
FIG. 3 is a flowchart of an embodiment of a method for the temperature and illumination adjusting system shown in FIG. 1.

FIG. 3 is a flowchart of an embodiment of a method for the temperature and illumination adjusting system shown in FIG. 1. In step S302, the central processing unit 110 receives the color temperature CCT and the illumination value L. Next, in step S304, the central processing unit 110 obtains the first formula and the second formula, generates the PWM value PWM1 and the PWM value PWM2 by substituting the color temperature CCT and the illumination value L into the first formula and the second formula. In step S306, the communication unit 120 transmits the PWM value PWM1 and the PWM value PWM2 from the central processing unit 110 to the lamp communication unit 210. In step S308, the lamp communication unit 210 transmits the PWM value PWM1 and the PWM value PWM2 to the PWM driving units 220 and 222. Finally, the PWM driving units 220 and 222 drive the light modules 230 and 232 according to the PWM value PWM1 and the PWM value PWM2. Therefore, the mixing light generated by the light modules 230 and 232 can match the color temperature CCT and the illumination value L of the user's request.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A temperature and illumination adjusting system, comprising:

a temperature and illumination adjusting device, comprising:

a central processing unit, receiving an illumination value and a color-temperature value, and generating a first PWM value and a second PWM value according to a first formula and a second formula;

a memory unit, storing the first formula and the second formula, wherein the first formula indicates the correlation between the first PWM value, the second PWM value and the illumination value, and wherein the second formula indicates the correlation between the first PWM value, the second PWM value and the color-temperature value; and a communication unit, outputting the first PWM value and the second PWM value; and a lamp device, comprising:

a lamp communication unit, receiving the first PWM value and the second PWM value;

a first light module;

a second light module;

a first PWM driving unit, driving the first light module by the first PWM value; and a second PWM driving unit, driving the second light module by the second PWM value, wherein the outputs of the first light module and the second light module have different color temperatures;

wherein the second formula is $PWM2/PWM1=c_1*e^{-CCT/c_2}+c_3$; and wherein PWM1 is the first PWM value, PWM2 is the second PWM value, $c_1$, $c_2$, $c_3$ are constants, and e is a mathematical constant.

2. The temperature and illumination adjusting system of claim 1, wherein the first formula is $PWM2=A(L)+B(L)*PWM1$, and wherein $A(L)=a_1+a_2L$, $B(L)=b_1+b_2L$, L is the illumination value, PWM1 is the first PWM value, PWM2 is the second PWM value, and $a_1$, $a_2$, $b_1$, $b_2$ are constants.

3. A temperature and illumination adjusting method, comprising:

obtaining an illumination value and a color-temperature value;

generating a first PWM value and a second PWM value according to a first formula and a second formula, wherein the first formula indicates the correlation between the first PWM value, the second PWM value and the illumination value, and wherein the second formula indicates the correlation between the first PWM value, the second PWM value and the color-temperature value;

transmitting the first PWM value and the second PWM value to an external lamp device;

driving the first light module of the external lamp device by the first PWM value; and driving the second light module of the external lamp device by the second PWM value, wherein the outputs of the first light module and the second light module have different color temperatures;

wherein the second formula is $PWM2/PWM1=c_1*e^{-CCT/c_2}+c_3$; and wherein PWM1 is the first PWM value, PWM2 is the second PWM value, $c_1$, $c_2$, $c_3$ are constants, and e is a mathematical constant.

4. The temperature and illumination adjusting method of claim 3, wherein the first formula is $PWM2=A(L)+B(L)*PWM1$, and wherein $A(L)=a_1+a_2L$, $B(L)=b_1+b_2L$, L is the illumination value, PWM1 is the first PWM value, PWM2 is the second PWM value, and $a_1$, $a_2$, $b_1$, $b_2$ are constants.

5. A temperature and illumination adjusting system, comprising:

a temperature and illumination adjusting device, comprising:

a central processing unit, receiving an illumination value and a color-temperature value, and generating a first PWM value and a second PWM value according to a first formula and a second formula;

a memory unit, storing the first formula and the second formula, wherein the first formula indicates the correlation between the first PWM value, the second PWM value and the illumination value, and wherein the second formula indicates the correlation between the first PWM value, the second PWM value and the color-temperature value; and a communication unit, outputting the first PWM value and the second PWM value; and a lamp device, comprising:

a lamp communication unit, receiving the first PWM value and the second PWM value;

a first light module;

a second light module;

a first PWM driving unit, driving the first light module by the first PWM value; and a second PWM driving unit, driving the second light module by the second PWM value, wherein the outputs of the first light module and the second light module have different color temperatures;

wherein the second formula is $PWM2/PWM1=c_1*e^{-CCT/c_2}+c_3*e^{-CCT/c_4}+c_5$; and wherein PWM1 is the first PWM value, PWM2 is the second PWM value, $c_1$, $c_2$, $c_3$, $c_4$, $c_5$ are constants, and e is a mathematical constant.

6. The temperature and illumination adjusting system of claim 5, wherein the first formula is $PWM2=A(L)+B(L)*PWM1$, and wherein $A(L)=a_1+a_2L$, $B(L)=b_1+b_2L$, L is the illumination value, PWM1 is the first PWM value, PWM2 is the second PWM value, and $a_1$, $a_2$, $b_1$, $b_2$ are constants.

7. A temperature and illumination adjusting method, comprising:

obtaining an illumination value and a color-temperature value;

generating a first PWM value and a second PWM value according to a first formula and a second formula, wherein the first formula indicates the correlation between the first PWM value, the second PWM value and the illumination value, and wherein the second formula indicates the correlation between the first PWM value, the second PWM value and the color-temperature value;

transmitting the first PWM value and the second PWM value to an external lamp device;

driving the first light module of the external lamp device by the first PWM value; and driving the second light module of the external lamp device by the second PWM value, wherein the outputs of the first light module and the second light module have different color temperatures;

wherein the second formula is $PWM2/PWM1=c_1*e^{-CCT/c_2}+c_3*e^{-CCT/c_4}+c_5$; and wherein PWM1 is the first PWM value, PWM2 is the second PWM value, $c_1$, $c_2$, $c_3$, $c_4$, $c_5$ are constants, and e is a mathematical constant.

8. The temperature and illumination adjusting method of claim 7, wherein the first formula is $PWM2=A(L)+B(L)*PWM1$, and wherein $A(L)=a_1+a_2L$, $B(L)=b_1+b_2L$, L is the illumination value, PWM1 is the first PWM value, PWM2 is the second PWM value, and $a_1$, $a_2$, $b_1$, $b_2$ are constants.

* * * * *